US007216703B2

(12) United States Patent
Smith

(10) Patent No.: US 7,216,703 B2
(45) Date of Patent: May 15, 2007

(54) METHOD AND APPARATUS FOR TESTING AND TREATMENT OF A COMPLETED WELL WITH PRODUCTION TUBING IN PLACE

(75) Inventor: Peter V. Smith, Balikpapan (ID)

(73) Assignee: Schlumberger Technology Corp., Sugar Land, TX (US)

( * ) Notice: Subject to any disclaimer, the term of this patent is extended or adjusted under 35 U.S.C. 154(b) by 372 days.

(21) Appl. No.: 10/839,443

(22) Filed: May 5, 2004

(65) Prior Publication Data

US 2004/0251022 A1 Dec. 16, 2004

Related U.S. Application Data

(60) Provisional application No. 60/469,537, filed on May 9, 2003.

(51) Int. Cl.
*E21B 47/00* (2006.01)

(52) U.S. Cl. ..... 166/250.17; 166/305.1; 166/113; 166/66

(58) Field of Classification Search ..... 166/250.17, 166/305.1, 113, 66, 77.2, 50, 152
See application file for complete search history.

(56) References Cited

U.S. PATENT DOCUMENTS

| | | | | |
|---|---|---|---|---|
| 4,590,998 | A * | 5/1986 | Hopper | 166/152 |
| 4,605,076 | A * | 8/1986 | Goodhart | 166/50 |
| 5,287,741 | A * | 2/1994 | Schultz et al. | 166/250.17 |
| 6,116,340 | A * | 9/2000 | Wilson et al. | 166/250.17 |
| 6,497,290 | B1 * | 12/2002 | Misselbrook et al. | 166/77.2 |

* cited by examiner

*Primary Examiner*—David Bagnell
*Assistant Examiner*—Matthew J. Smith
(74) *Attorney, Agent, or Firm*—Tim Curington; Robin Nava; Dale Gaudier

(57) ABSTRACT

A method and apparatus is used to test and/or treat individual production zones of a well in conjunction with a conventional coiled tubing unit. This method and apparatus allows testing and treatment of a well with production tubing in place. The return flowpath for formation fluids and/or treatment fluids is through the annulus between the coiled tubing and the production tubing. The preferred embodiment uses straddle packers, but alternative embodiments may use only a single inflatable packer.

6 Claims, 12 Drawing Sheets

METHOD AND APPARATUS FOR TESTING AND TREATMENT OF A COMPLETED WELL WITH PRODUCTION TUBING IN PLACE

CROSS REFERENCE TO RELATED APPLICATION

This application claims priority from U.S. Provisional Application entitled "Method for Coiled Tubing Treat and Cleanup/Test," Ser. No. 60/469,537, filed May 9, 2003, which is incorporated herein by reference.

BACKGROUND OF THE INVENTION

1. Field of the Invention

This invention relates to the testing and treatment of oil and gas wells, and in particular, to the testing and treatment of such wells with production tubing in place 2. Description of Related Art Testing is necessary to evaluate a well. Production testing occurs at various stages in the life of a well. For example, drill stem testing can be performed in an open hole before casing is set to establish the contribution from each identified potential producing zone.

A single subsurface formation can be tested in an open hole for production potential before casing has been set or the well has been completed. In some wells, multiple subsurface formations will be tested for production potential. If the well is deemed to have production potential, the open hole will be cased and the casing will be perforated at the subsurface formations that have tested favorably for hydrocarbon production.

One approach to production testing is disclosed in U.S. Pat. No. 6,543,540. The '540 patent discloses a method for performing production testing in open holes and in cased holes that avoids transporting formation fluid to the surface. Formation fluid is conducted from a first, expected permeable formation to a second permeable formation, as opposed to prior art techniques where fluid is conducted between a formation and the surface.

After a well has been cased, it must be perforated. Wells are often tested again after perforation, but before production tubing has been set. U.S. Pat. No. 6,543,538 discloses a method for perforating and treating multiple wellbore intervals before production tubing has been installed. One embodiment involves perforating at least one interval of the one or more subterranean formations penetrated by a given wellbore, pumping the desired treatment fluid without removing the perforating device from the wellbore, deploying some item or substance in the wellbore to removably block further fluid flow into the treated perforations, and then repeating the process for at least one more interval of subterranean formation. Another embodiment involves perforating at least one interval of the one or more subterranean formations penetrated by a given wellbore, pumping the desired treatment fluid without removing the perforating device from the wellbore, actuating a mechanical diversion device in the wellbore to removably block further fluid flow into the treated perforations, and repeating the process for at least one more interval of subterranean formation.

Another method for testing a cased well without production tubing is disclosed in U.S. Pat. No. 6,527,052. In this disclosure, drill pipe or coiled tubing is connected to a formation test assembly for testing a cased well. In one embodiment, the test is performed downhole without flowing fluids to the earth's surface. In another embodiment, a formation is perforated and fluids from the formation are flowed into a large surge chamber associated with a tubular string installed in the well. In another embodiment, fluids from a first formation are flowed into a tubular string installed in the well, and the fluids are then disposed of by injecting the fluids into a second formation. In yet another embodiment, fluids are flowed from a first formation and into a second formation utilizing an apparatus which may be conveyed into a tubular string positioned in the well.

If the well still appears viable after casing and perforation, production tubing will be set to complete the well, or additional perforating may occur. Drill stem testing procedures are not suitable on a completed well with production tubing in place because the drill pipe and equipment often used in drill stem testing will not fit in the production tubing. Further, conventional flow testing equipment cannot be run in production tubing even if the equipment is run on a wire line or a slick line.

After a well has been in production, the production rate may decline over time for a number of different reasons. It may therefore be necessary and desirable to test one or more subsurface production zones to better evaluate the reasons for the decline in production. Conventional tests on completed wells with production tubing in place are typically less comprehensive than drill stem tests in the open hole or a cased hole. The other option is to remove the production tubing for a conventional drill stem test. This latter approach is expensive. There is therefore a need to be able to run separate tests of each production zone in a completed well with production tubing in place.

One solution is disclosed in U.S. Pat. No. 5,353,875. In the '875 Patent, testing may be accomplished without removing the production tubing string from the well. The production of the well is shut down and then a coiled tubing test string is run down into the production tubing string. The coiled tubing test string includes a conveyance coiled tubing string, a tester valve carried by the conveyance coiled tubing string, and a test packer carried by the conveyance coiled tubing string. The test packer is set within one of the casing bore and the production tubing bore above perforations which communicate the casing bore with a subsurface formation. Drawdown and buildup testing of the subsurface formation can then be accomplished by opening and closing the tester valve to selectively flow well fluid up through the conveyance coiled tubing string or shut in the conveyance coiled tubing string. After the drawdown/buildup testing is completed, the coiled tubing test string is removed from the well and production of the well is resumed up through the production tubing bore. The problem with the method of the '875 patent is that hydrocarbons flow to the surface through the coiled tubing. Use of this flowpath is typically not a favored procedure in the field. Therefore, there is still a need for a method and apparatus that will facilitate testing of one production zone at a time in a completed well with production tubing in place.

If the testing procedures indicate that there is a problem, it is often preferable to stimulate or otherwise treat an existing well to improve production rates, rather than drill a new well. There are a number of ways to treat a completed well with multiple production zones, including matrix acidizing. In the past, it has been common to treat all production zones at one time. The problem with this prior art technique is that large amounts of acid are pumped into the well. After the acid is returned to the surface, it must be disposed. Further, treatment of all production zones may not have been necessary because only one production zone may have had a problem. Therefore, there is a need for a method and apparatus that will facilitate treatment of one production zone at a time in a completed well with production tubing in place.

One technique that has been suggested for treatment of one production zone at a time in a completed well with production tubing in place is described in U.S. Pat. No. 5,350,018. This technique uses inflatable packers to isolate a production zone. Treatment fluid is pumped down the coiled tubing to the zone and the treatment fluid and hydrocarbons flow back up the coiled tubing after the treatment. Again, it is desirable to avoid flowing hydrocarbons up the coiled tubing to the surface. There is still a need for a method and apparatus that avoids return flow through the coiled tubing. (See also U.S. Pat. No. 4,913,231).

A downhole stripper is used in the present invention. This downhole stripper is an existing electric submersible pump (ESP) bypass logging plug already available but not used in the same way as the present invention. Both PCE and Phoenix Petroleum Services market this logging plug.

An annular control tubing injection valve, sometimes referred to as an ACTIV, is also used in the present invention. Prior art exists on annular communication tools, such as a pick-up unloader used in packer operations marketed by Petro Tech Tools, a division of Schlumberger, as Product No. 3544. The pick-up unloader is tension and compression-activated. The pick-up unloader is a simple version of an ACTIV. Schlumberger pressure pulse technology (IRIS) may also be used to open and close the ACTIV.

BRIEF SUMMARY OF THE INVENTION

The present invention is a method and apparatus for testing and/or treatment of a single production zone and/or multiple production zones in a completed well with production tubing in place. A conventional coiled tubing unit is utilized to insert and retrieve unique downhole tool assemblies. The conventional coiled tubing unit includes the coiled tubing reel, a control cabin, power pack, injector head assembly, and blow-out preventer (BOP) stack. Various types of BOP's may be used but quad BOP's are often encountered. Quad BOP's frequently include blind rams, shear rams, slip rams, pipe rams, and equalizing valves.

The preferred embodiment of the present invention includes a conventional coiled tubing unit at the surface. The coiled tubing string from the reel connects to a downhole conveyance assembly, which connects to a conveyance coiled tubing string, which connects to a downhole test/treat assembly. The preferred embodiment also includes a downhole stripper removably set in the production tubing, through which the conveyance tubing string can move. The downhole conveyance assembly includes several components one of which is the annular control tubing injection valve (ACTIV), previously discussed. The downhole test/treat assembly includes several components, one of which is called a drag spring reversing check valve which will sometimes be referred to as a "DSRV". The drag spring reversing valve is disclosed in U.S. patent application Ser. No. 10/254,134, filed on Sep. 25, 2002, which application is incorporated herein by reference.

The present method utilizes a flow path for the well fluid and/or treatment fluid that differs from the prior art. An annulus is defined between the coiled tubing and the production tubing above the stripper. Well fluid and/or treatment fluid flows up through this annulus between the production tubing and the coiled tubing above the ACTIV. This unique annular flow path avoids hydrocarbons and treatment fluid passing up the coiled tubing string to the wellhead on the surface.

DETAILED DESCRIPTION OF THE INVENTION

Figure 1:
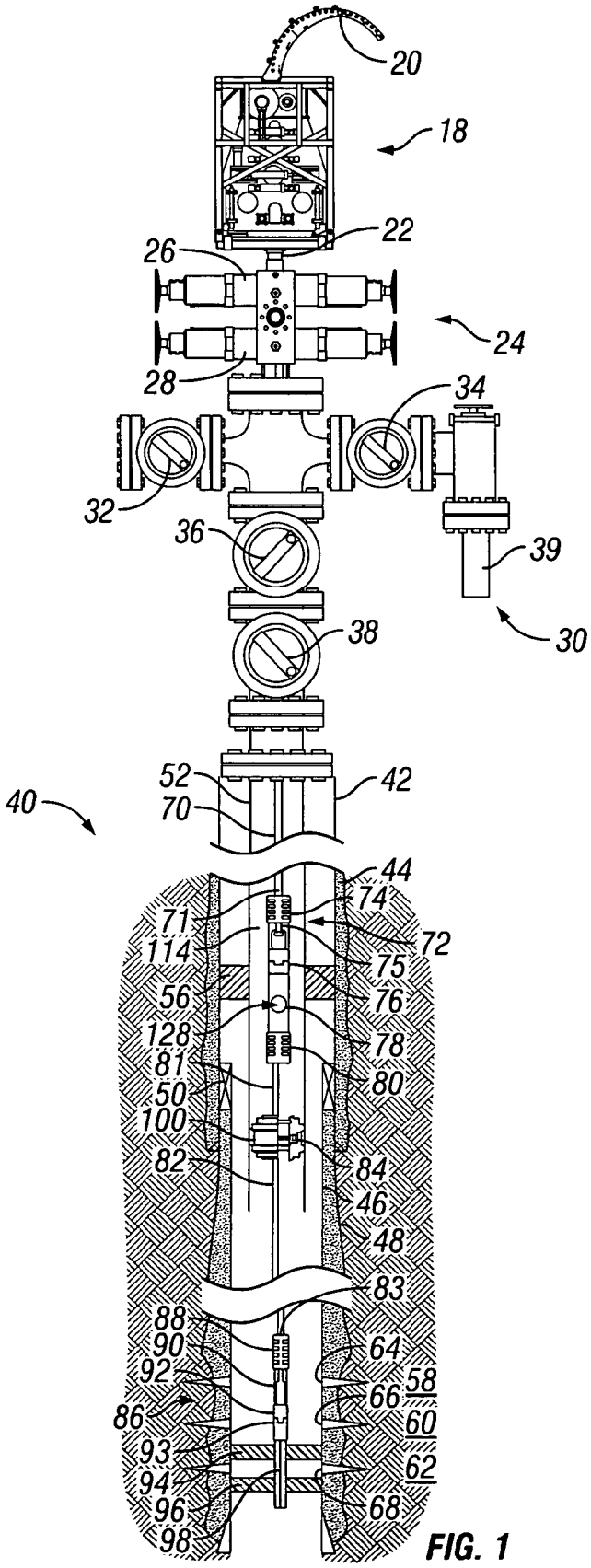
FIG. 1 is a partial sectional view of a well with production tubing in place and the apparatus of the present invention in the hole with inflatable packers inflated to isolate a single production zone for testing and/or treatment.

FIG. 1 is a partial sectional view of a well with production tubing in place and the apparatus of the present invention in the hole with inflatable packers inflated to isolate a single production zone for testing and/or treatment. A conventional coiled tubing unit is positioned on the wellhead.

The conventional coiled tubing unit includes a coiled tubing reel, not shown, a power plant, not shown, a control cabin, not shown, and an injector head assembly generally identified by the numeral 18. The injector head assembly 18 includes a gooseneck 20 and a stripper 22. A BOP assembly is generally identified by the numeral 24, having at least slip rams 26 and pipe rams 28. The configuration of a conventional coiled tubing unit is well known to one skilled in the art.

A wellhead 30, sometimes know in the industry as a Christmas tree, includes a first valve 32, a second valve 34, a third valve 36, a fourth valve 38 and a wellhead outlet 39. Various valve configurations are possible at the wellhead 30 and this arrangement is merely illustrative of one such configuration.

A well is generally identified by the numeral 40. Casing 42 is shown set in the hole with cement 44. A production casing liner 46 is shown set in the hole with cement 48. A hanger liner with packoff 50 seals the outer circumference of the production casing liner 46 to the inner circumference of the casing 42 as is generally known to one skilled in the art.

Production tubing 52 has been placed in the casing 42 and sealed with a completion packer 56. The well 40 has a first subterranean production zone 58, a second subterranean production zone 60 and a third subterranean production zone 62. First perforations 64 extend through the production casing liner 46 into the first production zone 58. Second perforations 66 extend through the production casing liner 46 into the second production zone 60. Third perforations 68 extend through the production casing liner 46 into the third production zone 62.

A coiled tubing string 70 connects to the downhole conveyance assembly, generally identified by the numeral 72. The downhole conveyance assembly 72 includes a connector 74, a standard check valve 75, a release joint 76, an annular control tubing injection valve 78 (ACTIV) and a connector 80. The connector 74 connects to the terminus 71 of the coiled tubing string 70. The connector 80 connects to the upper terminus 81 of conveyance coiled tubing string 82.

The ACTIV has two positions. The first position is closed which allows fluid to pass through the coiled tubing string 70, through the downhole conveyance assembly 72, including the ACTIV to the conveyance coiled tubing string 82, discussed below. While going into the well, the ACTIV can either be in the open or closed position. The second position of the ACTIV is open. The ACTIV is placed in the open position during testing and in the closed position during treatment of the well. In the open position, fluid from production zones in the well flows up to the ACTIV and out open ports 128 to an annulus 114, as discussed in connection with FIG. 10 below.

A downhole stripper 84 surrounds the conveyance coiled tubing string 82. The test/treat assembly generally identified by the numeral 86 includes a connector 88, a drag spring reversing valve 90 (DSRV), a release joint 92, a logging tool assembly 93, a first inflatable packer 94 and a second inflatable packer 96 positioned on a spacer pipe 98. The connector 88 connects to the lower terminus 83 of the conveyance coiled tubing string 82. The structure and operation of the DSRV are fully described in the previously identified patent application.

Landing nipples 100 are positioned inside the production tubing 52. The downhole stripper 84 has engaged the landing nipples 100 and the conveyance coiled tubing string 82 passes up and down through the downhole stripper 84.

Figure 2:
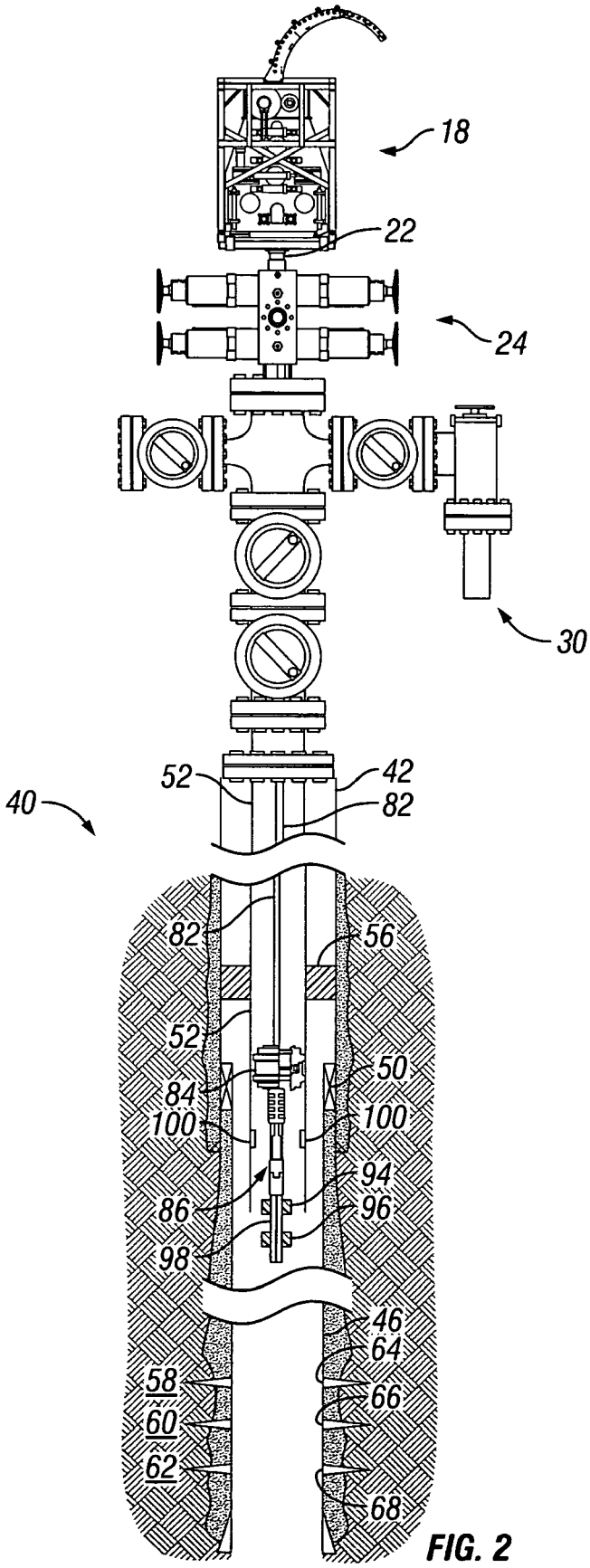
FIG. 2 is a partial sectional view of the well of FIG. 1 with production tubing in place and the downhole test/treat assembly run in the hole near the terminus of the production tubing.

FIG. 2 is a partial sectional view of the well 40 of FIG. 1 with production tubing 52 in place. The downhole test/treat assembly 86 has been deployed in the well 40 inside the production tubing 52. A sufficient length of the conveyance coiled tubing string 82 has been deployed in the well so the downhole stripper 84 is proximate the landing nipples 100. In this view, the downhole stripper 82 has not yet engaged the landing nipples 100. The inflatable packers 94 and 96 have not been inflated.

Figure 3:
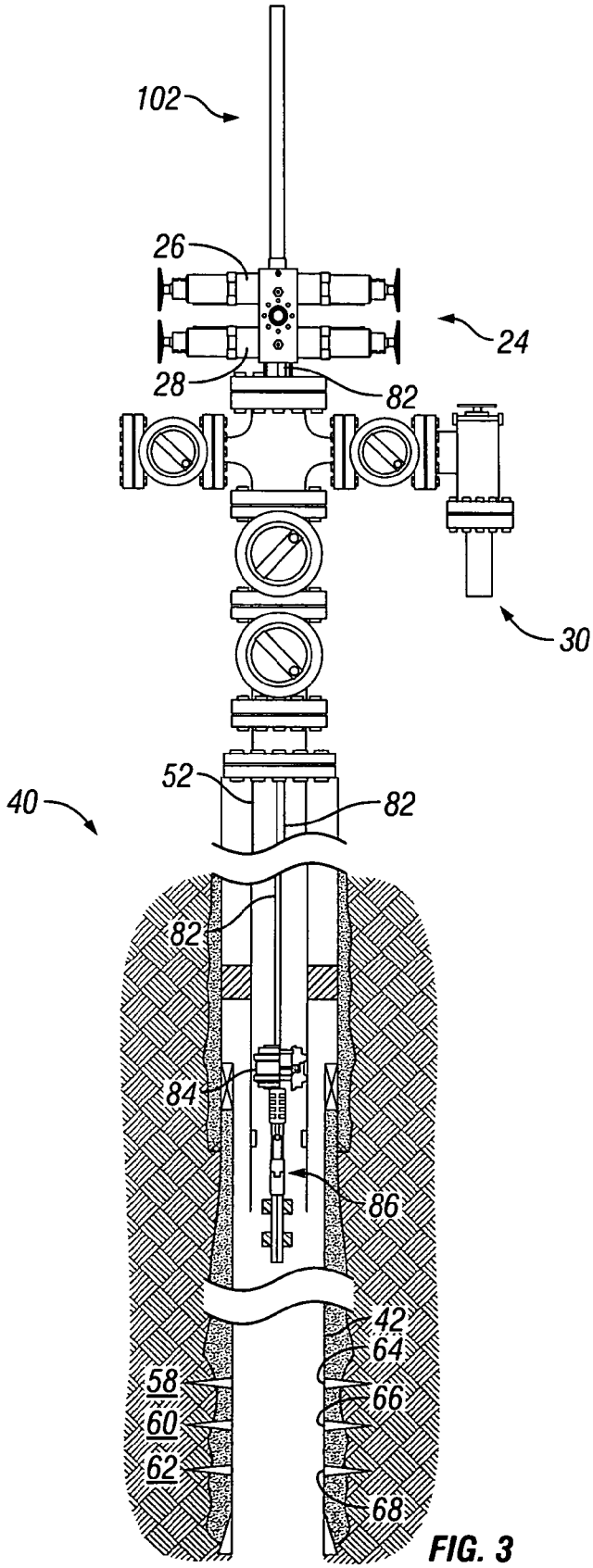
FIG. 3 is a partial sectional view of the well of FIG. 1 with production tubing in place and the injector head assembly removed to expose a portion of the conveyance coiled tubing string.

FIG. 3 is a partial sectional view of the well 40 of FIG. 1 with production tubing 52 in place and the injector head assembly 18 removed to expose a portion 102 of the conveyance coiled tubing string 82. The conveyance coiled tubing string 82 is hung off the BOP 24 using the pipe slip rams 28. The rams 26 are used for well control contingency purposes. The exposed portion 102 of the conveyance coiled tubing string 82 is cut off prior to connection of the downhole conveyance assembly 72 as shown in FIG. 4.

Figure 4:
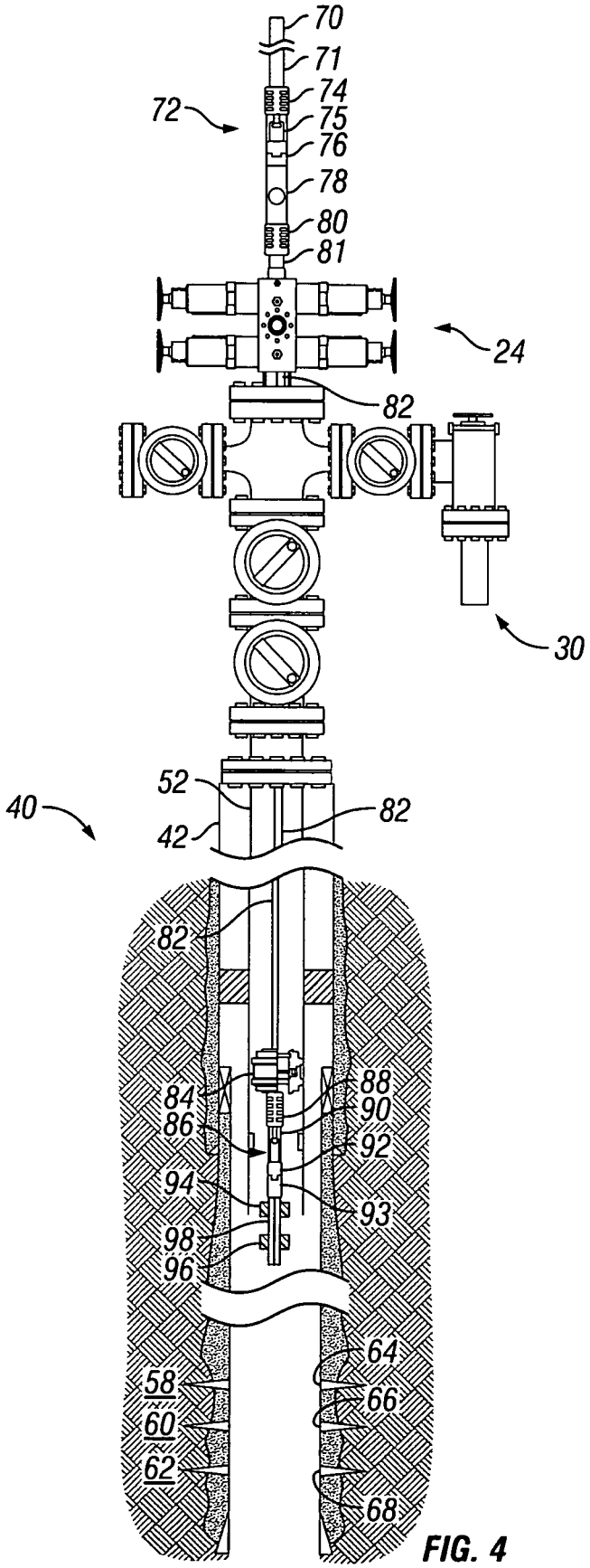
FIG. 4 is a partial sectional view of the well of FIG. 1 with production tubing in place, with the downhole test/treat assembly run in the hole and connected to the conveyance coiled tubing string and the downhole conveyance assembly connected on one end to the conveyance coiled tubing and on the other end to the coiled tubing string.

FIG. 4 is a partial sectional view of the well 40 of FIG. 1 with the production tubing 52 in place, with the downhole test/treat assembly 86 run in the well and connected to the conveyance coiled tubing string 82. While the injector head assembly, not shown, is suspended above the BOP assembly 24 the connector 80 of the downhole conveyance assembly 72 is connected is connected to the upper terminus of the conveyance coiled tubing string 82. The connector 74 of the downhole conveyance assembly is connected to the terminus 71 of the coiled tubing string 70.

Figure 5:
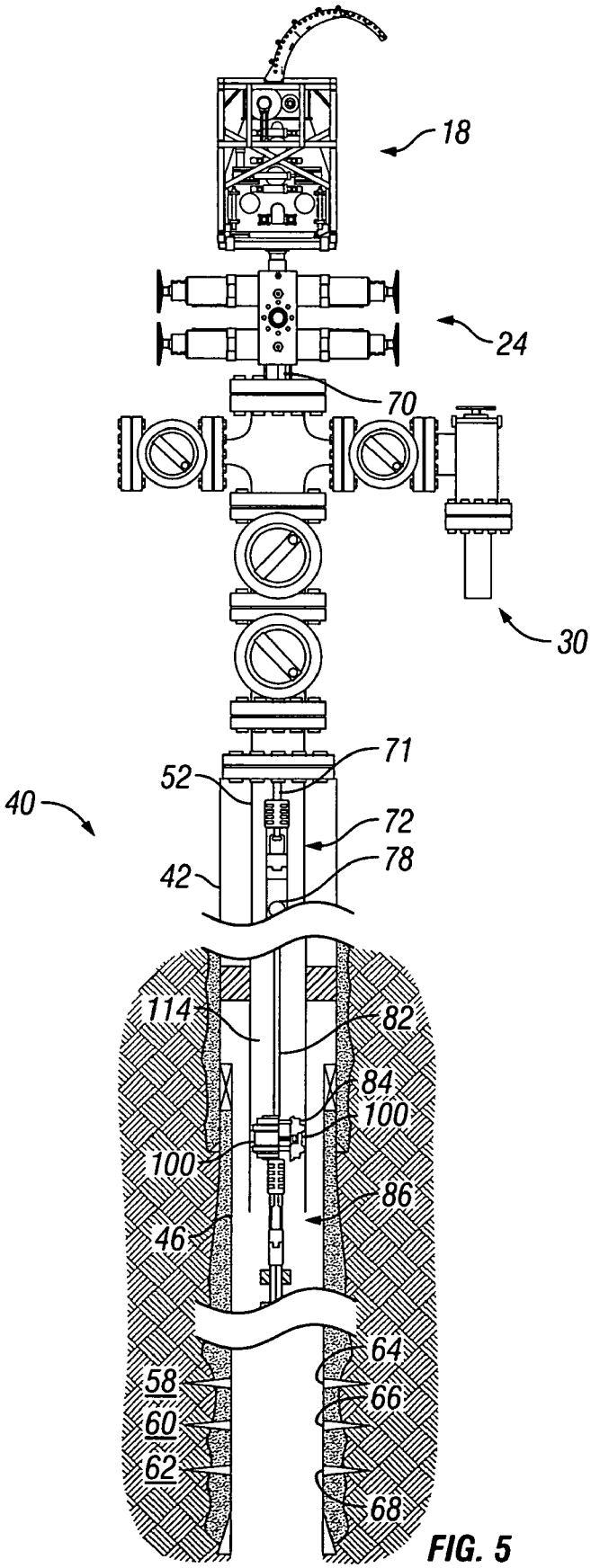
FIG. 5 is a partial sectional view of the well of FIG. 1 with production tubing in place, with the injector head assembly in place and the downhole stripper proximate the landing nipples.

FIG. 5 is a partial sectional view of the well 40 of FIG. 1 with the production tubing 52 in place. The injector head assembly 18 is repositioned on the BOP assembly. The coiled tubing 70 is run into the hole to a depth where the downhole stripper 84 is properly aligned with the landing nipples 100. The downhole stripper 84 is engaged with the landing nipples 100 which seals the production tubing to fluid flow from the production zones 58, 60 and 62.

Figure 6:
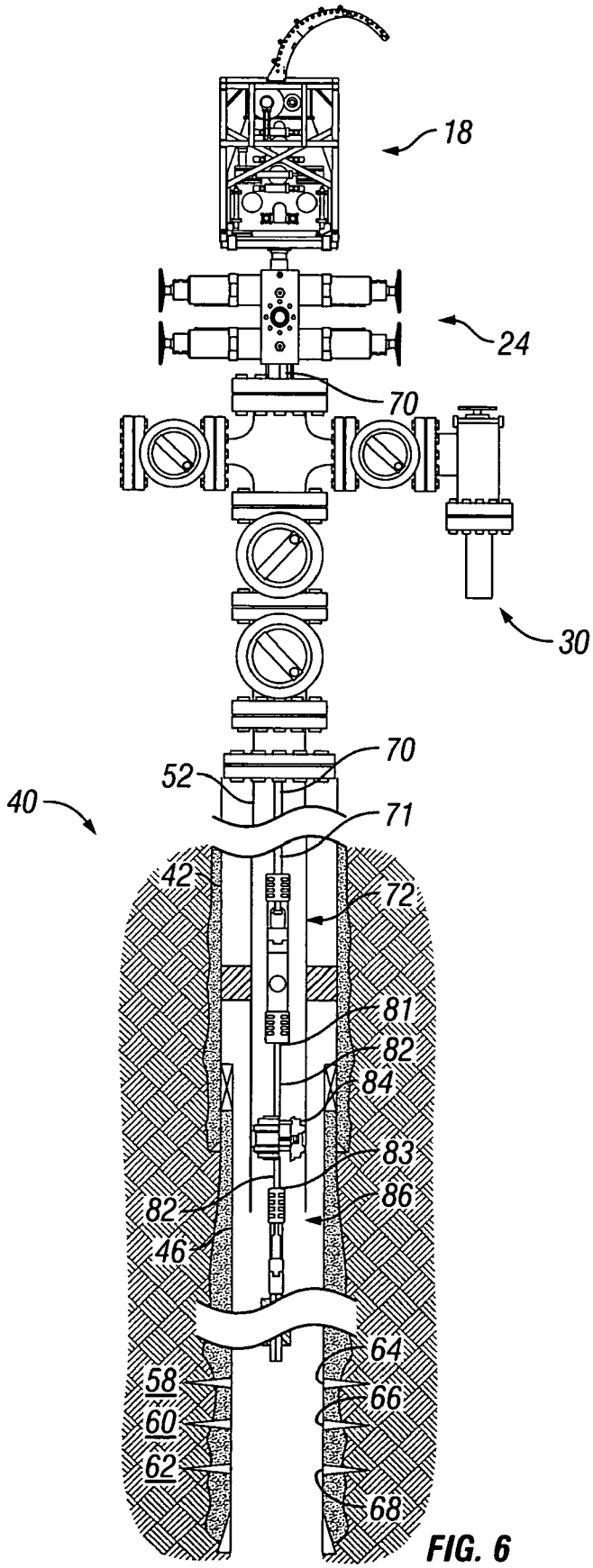
FIG. 6 is a partial sectional view of the well of FIG. 1 with production tubing in place, with the downhole test/treat assembly and the downhole conveyance assembly run in the hole.

FIG. 6 is a partial sectional view of the well 40 of FIG. 1 with production tubing 52 in place. The coiled tubing string 70 has been run further into the well. This allows the conveyance coiled tubing string 82 to slide through the downhole stripper 84 with the downhole test/treat assembly 86 being lowered deeper into the well.

Figure 7:
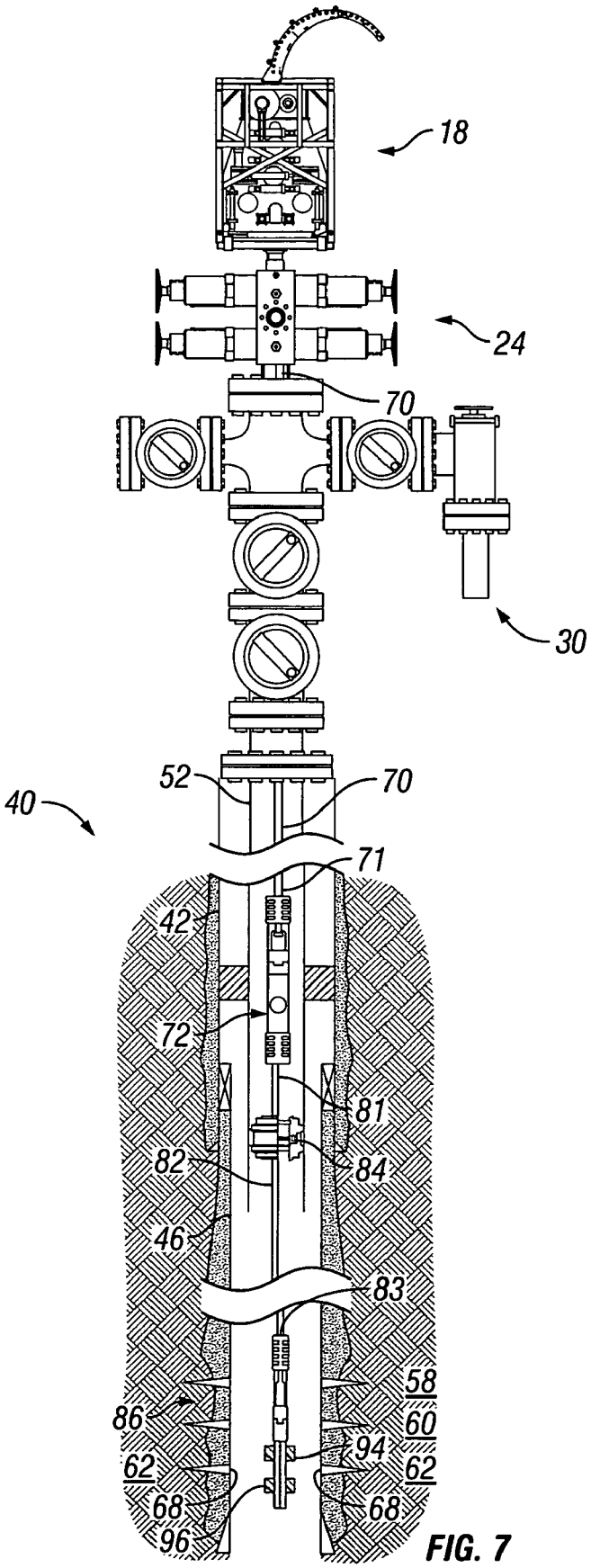
FIG. 7 is a partial sectional view of the well of FIG. 1 with production tubing in place and the downhole test/treat assembly run into the hole to a depth proximate a production zone.

FIG. 7 is a partial sectional view of the well 40 of FIG. 1 with production tubing 52 in place. The coiled tubing 70 has been run further into the well. This allows the conveyance coiled tubing string 82 to slide through the downhole stripper 84 with the downhole test/treat assembly 86 being positioned proximate the third production zone 62 and the third perforations 68. The packers 94 and 96 are positioned above and below the third perforations 68 prior to inflation, which is shown in the next figure.

Figure 8:
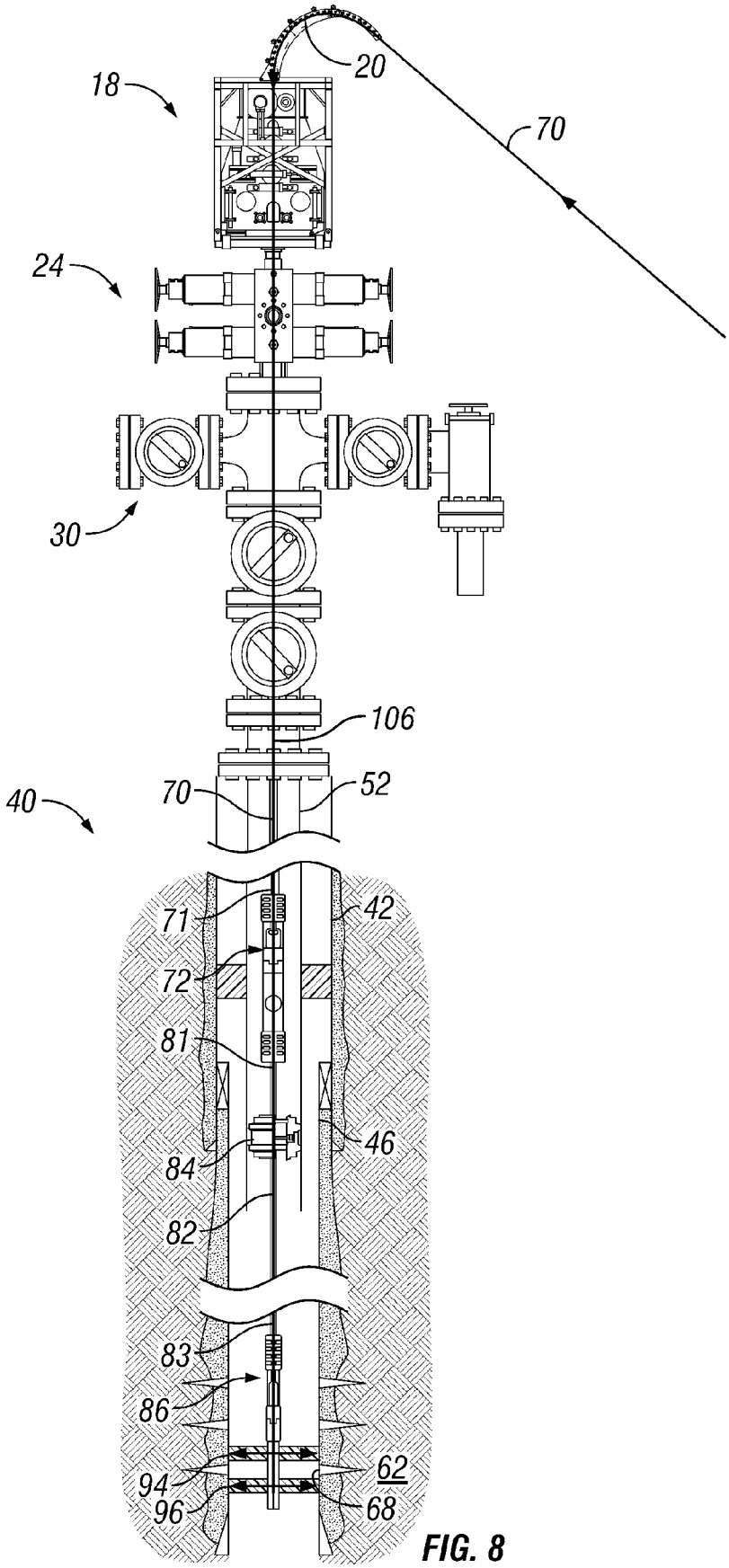
FIG. 8 is a partial sectional view of the well of FIG. 1 with production tubing in place and the inflatable packers inflated to isolate a single production zone for treatment and/or testing.

FIG. 8 is a partial sectional view of the well 40 of FIG. 1 with the production tubing 52 in place. Fluid 106 is pumped through the coiled tubing string 70, to inflate the first inflatable packer 94 and the second inflatable packer 96. The fluid 106 passes through the coiled tubing string 70, the downhole conveyance assembly 72, the conveyance coiled tubing string 82, and into the downhole test/treat assembly 86 to the inflatable packers 94 and 96. The fluid 106 inflates the inflatable packers as shown in this figure to isolate a single production zone for testing and/or treatment. In this view, the third production zone 62 has been isolated for testing and/or treatment. By repositioning the inflatable packers in the well, the first production zone 58 or the second production zone 60 could also be selectively isolated for testing and/or treatment.

Figure 9:
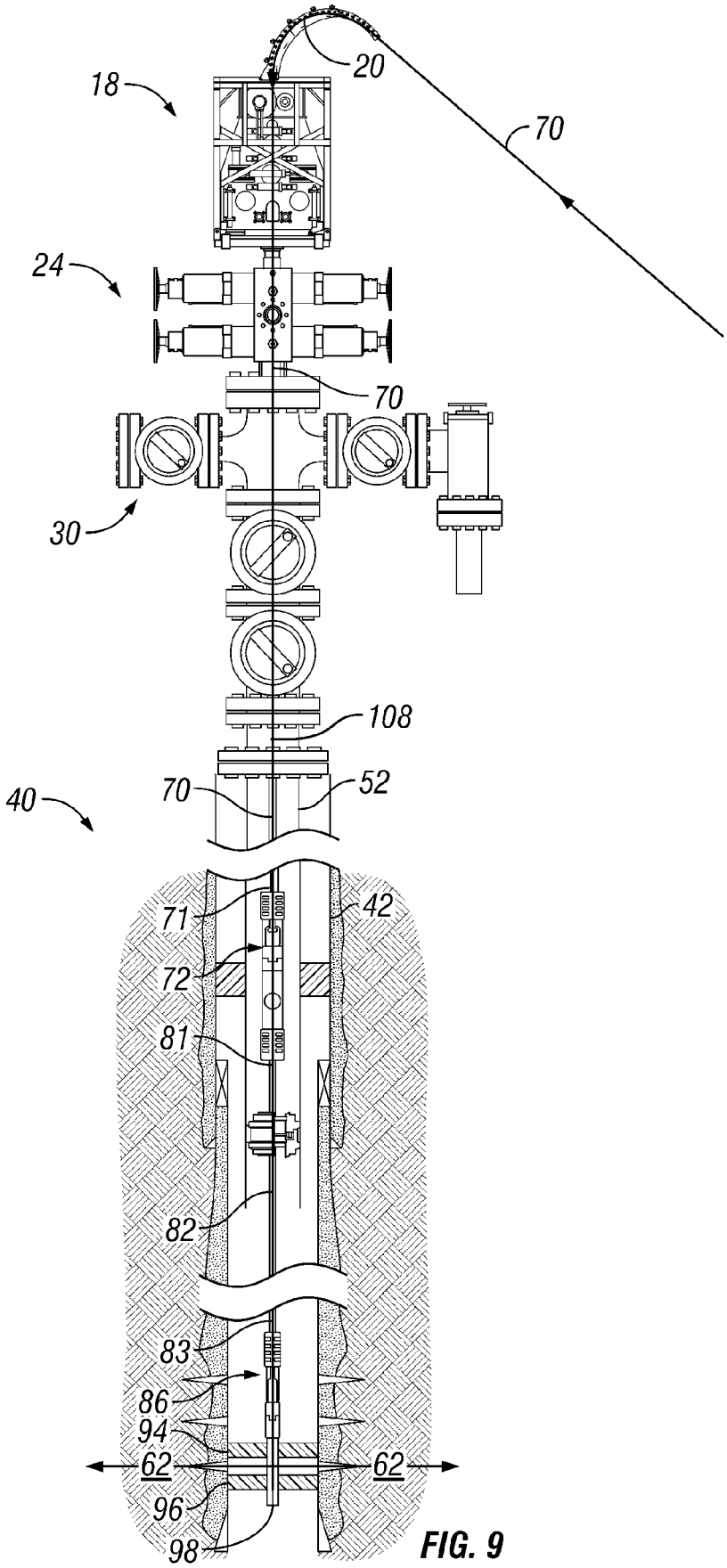
FIG. 9 is a partial sectional view of the well of FIG. 1 with production tubing in place and treatment fluid being injected into a single production zone that has been isolated by the inflatable packers.

FIG. 9 is a partial sectional view of the well 40 of FIG. 1 with the production tubing 52 in place. Treatment fluid 108 is pumped from a tanker truck or other large container, not shown by a pump, not shown, into the third production zone 62 that has been isolated by the inflatable packers 94 and 96. The treatment fluid 108 passes through the coiled tubing string 70, the downhole conveyance assembly 72, the conveyance coiled tubing string 82 and the downhole test/treat assembly 86 where it is isolated between the first inflatable packer 94, the second inflatable packer 96 and the inside circumference 110 of the production casing liner 46. Because the treatment fluid 108 is pumped under pressure, it then passes through the third perforations 68 into the third production zone 62. If the treatment procedure is matrix acidizing, the treatment could consist of hydrochloric acid or any other suitable acid or treatment fluid. Other treatment procedures can be used with this invention including the pumping of solvents to remove waxes or asphaltenes, gels for water or gas shut off.

Figure 10:
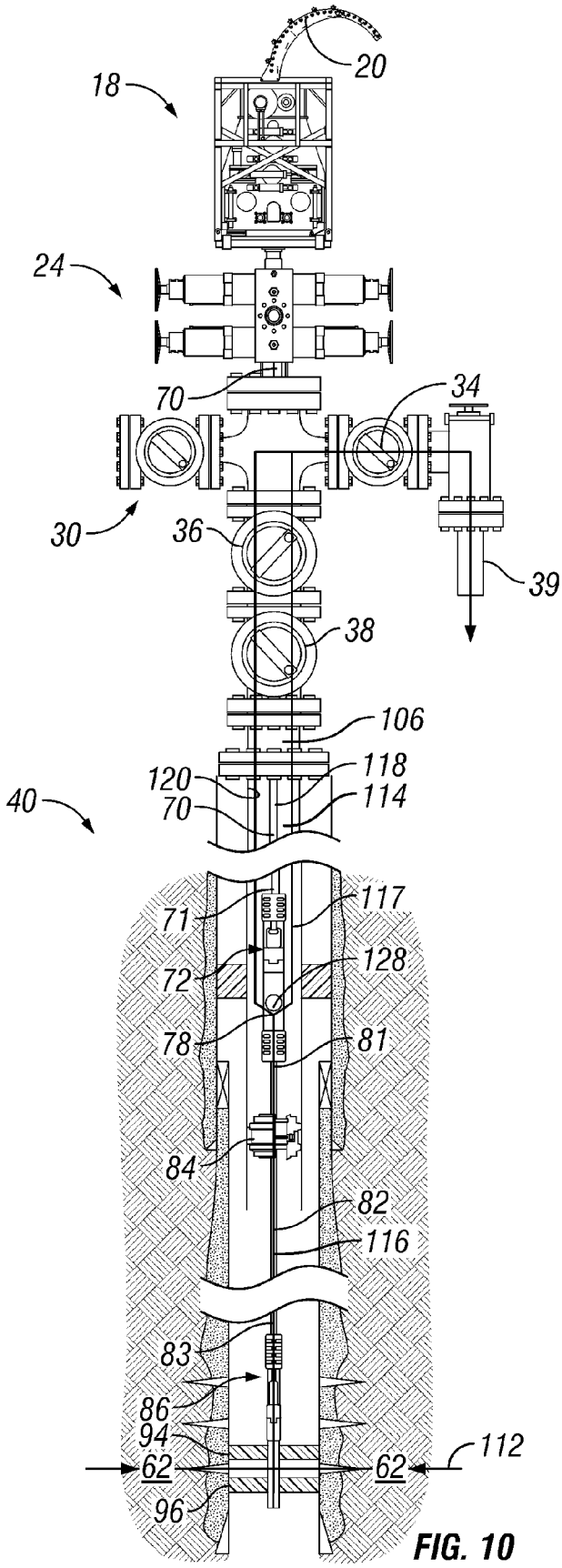
FIG. 10 is a partial sectional view of the well of FIG. 1 with the production tubing in place and treatment fluid and formation fluid from the production zone flowing back to the wellhead. The same flowpath is utilized during a test of the production zone, except only formation fluid flows back to the wellhead.

FIG. 10 is a partial section view of the well 40 of FIG. 1 with the production tubing 52 in place. Treatment fluid 108 and formation fluid 112 from the third production zone 62 become commingled fluids 116 and flow back to the wellhead 30. The commingled fluids 116 exit the wellhead at the wellhead outlet 39. The commingled fluids 116 thereafter enter a pipeline, not shown or a tanker truck, not shown for processing.

The annular flowpath 117 of the commingled fluids 116 is as follows: through the downhole test/treat assembly 86, through the conveyance coiled tubing string 82, through the downhole conveyance assembly 72 and out the annular control tubing injection valve (ACTIV) 78 into the annulus 114 up to and out the wellhead 30. The annulus 114 is formed between the outside circumference 118 of the coiled tubing string 70 and the inside circumference 120 of the production tubing 52. The annulus 114 is isolated from the well by the downhole stripper 84 and the BOP assembly 24. The same annular flowpath 117 is utilized during a test of a production zone, except formation fluid flows 112 flow back to the wellhead 30 instead of the commingled fluids 116 that flow back after a treatment of the well 40.

The annular flowpath 117 up the annulus 114 to the wellhead 30 is unique in the field of test and/or treatment of wells with production tubing in place. The annular flowpath 117 avoids flowing hydrocarbons to the surface through the coiled tubing 70, which is advantageous, for the reasons discussed above.

Figure 11:
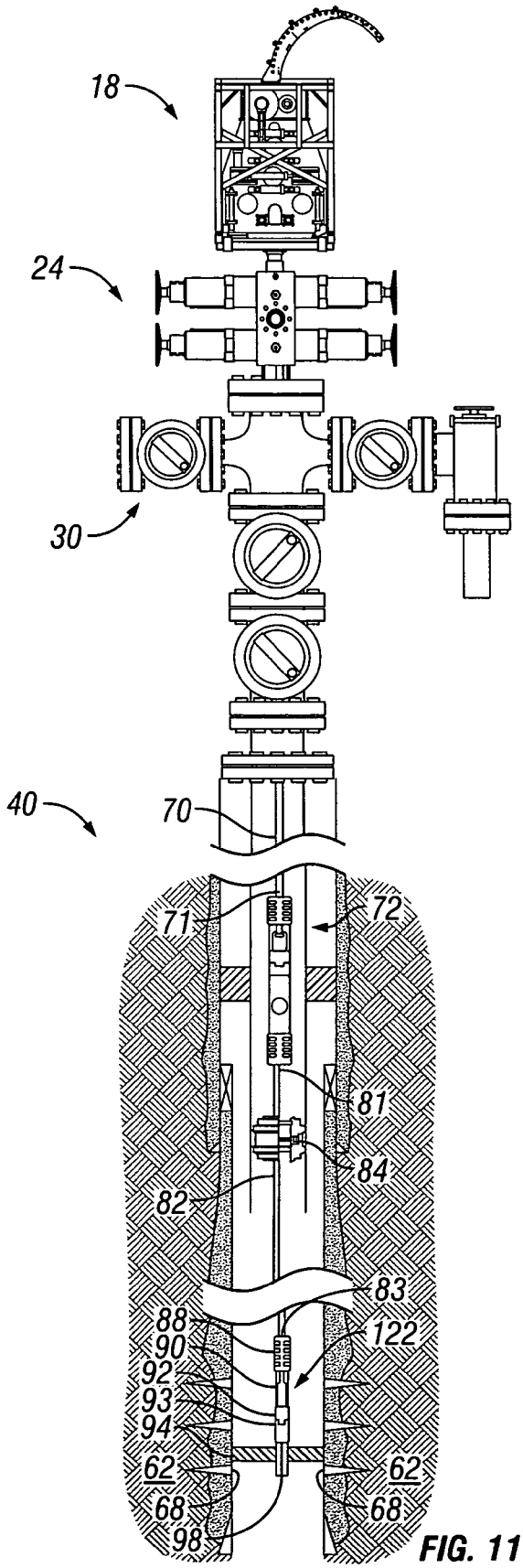
FIG. 11 is a partial sectional view of the well of FIG. 1 with production tubing in place with an alternative embodiment of the present invention that utilizes a single packer.

FIG. 11 is a partial sectional view of the well 40 of FIG. 1 with production tubing 52 in place. An alternative embodiment of the present invention is shown. The alternative embodiment of a downhole test/treat assembly 122 only utilizes a single packer 94 instead of the inflatable packers 94 and 96 used in the downhole test/treat assembly 86. Further, this alternative embodiment of the downhole test/treat assembly 122 is only able to test/treat a single production zone and it must be the deepest production zone in the well. In this figure, the deepest production zone is the third production zone 62. Otherwise, the method of testing and treatment of the production zone 62 is the same as previously described for the primary embodiment in the preceding figures. The downhole test/treat assembly 122 includes a connector 88, drag spring reversing valve (DSRV) 90, a release joint 92, a logging tool assembly 93, a first straddle packer 94 and a spacer pipe 98.

Figure 12:
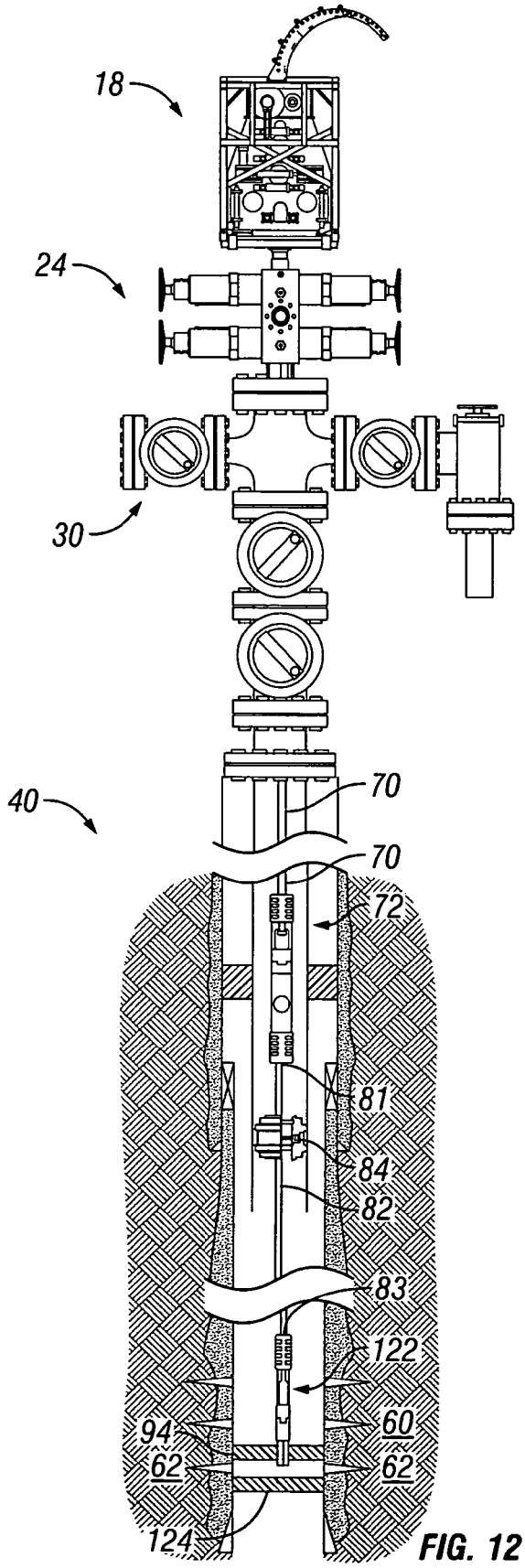
FIG. 12 is a partial sectional view of a well with production tubing in place with another alternative embodiment of the present invention that utilizes a single packer and a mechanical or inflatable bridge plug previously run and set in the well.

FIG. 12 is a partial sectional view of the well 40 of FIG. 1 with production tubing 52 in place. In this alternative embodiment of the present invention, a mechanical or inflatable bridge plug 124 has been previously run and set in the well below the production zone of interest. In this figure, the bridge plug 124 has been set below the second production zone 60. The alternative embodiment of the downhole test/treat assembly 122 that utilizes a single packer 94 is positioned above the production zone of interest. In this figure, the first inflatable packer 94 is positioned above the second production zone 60. Therefore, the second production zone 60 has been isolated for test and/or treatment. The second production zone 60 has been isolated by the first inflatable packer 94 on the downhole test/treat assembly and the bridge plug 124. The method of testing and/or treatment of the production zone 60 is the same as previously described for the primary embodiment in the preceding figures.

Operational Example for Test/Treat

The following example is hypothetical. A well is approximately 10,000 feet deep with a first production zone at approximately 8750 feet, a second production zone at approximately 8850 feet deep and a third production zone at approximately 9000 feet deep. Casing has been set to approximately 8600 feet in the hole followed by a production casing liner for approximately from 8500 to 10000 feet. Production tubing has been installed to approximately 8700 feet. A hanger liner with packoff 50 has been set between the casing and the production casing liner at approximately 8550 feet. Landing nipples are positioned in the production tubing at approximately 8600 feet. The completion packer 56 is set at about 8450 feet between the casing and the production tubing.

A conventional coiled tubing unit is brought to the well and the well is shut in. The BOP assembly is connected to the wellhead and the injector head assembly is mounted on the BOP assembly. The downhole test/treat assembly 86 is connected to the lower terminus 83 of the conveyance coiled tubing string 82. The downhole test/treat assembly and the conveyance coiled tubing string are deployed into the injector head assembly and the BOP assembly and run into the production tubing 52 to a depth of about 500 feet as shown in FIG. 2. As shown in FIG. 3, the injector head assembly 18 is removed, exposing a portion of the conveyance coiled tubing string which is cut off.

As shown in FIG. 4, the downhole conveyance assembly 72 is connected to the upper terminus 81 of the conveyance coiled tubing string and to the terminus 71 of the coiled tubing string 70.

As shown in FIG. 5, the injector head assembly is, reconnected to the BOP stack and the downhole test/treat assembly 86, the downhole stripper 84 and the downhole conveyance assembly 72 are run into the well to a depth of about 8600 feet. While running into the well, the ACTIV is closed to the annulus 114. While running in the well the DSRV is closed to reverse flow, up towards the surface. At this depth the downhole stripper 84 is proximate the landing nipples 100. Sufficient compressive force is then applied to the coiled tubing string 70, which is transmitted through the conveyance coiled tubing string 82 to the downhole stripper 84 which locks it in place with the landing nipples 100. When the downhole stripper is locked in place at about 8600 feet, it also seals the production tubing and isolates it from the rest of the well.

Additional compressive force on the coiled tubing string 70 releases the downhole stripper from the downhole test/treat assembly 86. This allows the conveyance coiled tubing string 82 to slip through the downhole stripper 84 as more of the coiled tubing string 70 is run in the well as best seen in FIG. 6.

The packers 94 and 96 are positioned so they straddle the third production zone 62 at about 9,000 feet. As shown in FIG. 7. Once the straddle packers have reached the desired setting depth, the coiled tubing string 70 will be moved up hole to deactivate the check valves in the DSRV. This will then allow both direct flow down into the well and reverse flow up to the surface. Again, the structure and operation of the DSRV are more fully described in the prior patent application identified above and incorporated herein by reference.

A pump, not shown, pumps fluid down the coiled tubing string 70, through the downhole conveyance assembly 72, through the conveyance coiled tubing string 82, and through the downhole test/treat assembly 86 to inflate the straddle packers 94 and 95 as shown in FIG. 8. When the packers have been set, the third production zone 62 is isolated from the rest of the well by the packers which seal against the inside circumference of the production casing liner 46.

To test the third production zone, the coiled tubing string is then put into tension sufficiently to cycle the mechanism in the ACTIV 78 to the open to annulus position and, when weight is set back down, the ACTIV open ports 128 then allow annular communication. In other words, fluid flows towards the surface through the conveyance coiled tubing string 82 through the connector 80, and through the open ports to the annulus 114. The well is allowed to flow from the third production zone as shown in FIG. 10, through the downhole test/treat assembly 86, through the conveyance coiled tubing string 82, through the downhole conveyance assembly 72 and out the ACTIV 78 into the annulus 114. The formation fluid passes through the wellhead and out the wellhead outlet 39. The logging tool assembly 93 measures flow, temperature and other variables to test the third production zone 62. Data from the logging tool 93 can be sent in real time up to the surface by electric wireline logging cable, preinstalled in the coiled tubing. In the alternative, the data can be stored in memory and analyzed after the logging tool is removed from the well. In the preferred embodiment, the data is sent to the surface while the logging tool assembly is still in the well. Other production zones may be tested individually by deflating the straddle packers and repositioning the downhole test/treat assembly to the next zone. The packers are then reinflated and formation fluid is allowed to flow to the surface. After all zones of interest have been tested, it is time to treat one or more production zones. The present invention allows different zones to tested selectively. The test results may show that only one production zone needs treatment.

Assuming that only the third production zone 62 needs treatment, it is not necessary to reposition the packers from the location shown in FIG. 10. In order to treat the third production zone 62, the coiled tubing string is then put into tension sufficiently to cycle the mechanism in the ACTIV to the closed to annulus position and, when weight is set back down, the ACTIV open ports 128 then prevent annular communication. The treatment fluid is pumped down the coiled tubing string 70, through the downhole conveyance assembly 72, through the conveyance coiled tubing string 82, and through the downhole test/treat assembly 86 as shown in FIG. 9 into the third production zone 62. After a sufficient amount of treatment fluid has been pumped in the well, the pump is stopped.

The coiled tubing string is then put into tension sufficiently to cycle the mechanism in the ACTIV 78 to the open to annulus position and, and when weight is set back down, the ACTIV open ports 128 then allow annular communication. In other words, fluid flows towards the surface through the conveyance coiled tubing string 82 through the connector 80, and through the open ports to the annulus 114.

The flowpath for the comingled fluid is the same as shown in FIG. 10. The commingled fluid flows from the third production zone, through the downhole test/treat assembly 86, through the conveyance coiled tubing string 82, through the downhole conveyance assembly 72 and out the open ports 128 of the ACTIV 78 into the annulus 114. The commingled fluid flows up the annulus 114 to the wellhead and out the wellhead outlet 39. This flowpath up the annulus instead of the coiled tubing 70 differentiates the present method for the prior art for both testing and treatment of a well. After the formation has cleared itself of the treatment fluid, the production wing valves in the wellhead can be closed to stop the flow.

Once a treatment is completed, the straddle packers can be unset with tension applied and moved uphole to treat another production zone, if necessary. Once all production zones have been treated, the downhole test/treat assembly 86 is retrieved from the well. On the way out of the well, the downhole stripper 84 is disengaged and retrieved with the downhole test/treat assembly.

Operational Example for Treatment of a Well

The following example is hypothetical. A well is approximately 10,000 feet deep with a first production zone at approximately 8750 feet, a second production zone at approximately 8850 feet deep and a third production zone at approximately 9000 feet deep. Casing has been set to approximately 8600 feet in the hole followed by a production casing liner for approximately from 8500 to 10000 feet. Production tubing has been installed to approximately 8700 feet. A hanger liner with packoff 50 has been set between the casing and the production casing liner at approximately 8550 feet. Landing nipples are positioned in the production tubing at approximately 8600 feet. The completion packer 56 is set at about 8450 feet between the casing and the production tubing.

A conventional coiled tubing unit is brought to the well and the well is shut in. The BOP assembly is connected to the wellhead and the injector head assembly is mounted on the BOP assembly. The downhole test/treat assembly 86 is connected to the lower terminus 83 of the conveyance coiled tubing string 82. When the assembly 86 is being used solely for treatment of a well, as contemplated by this example, the logging tool assembly 93 is an optional component. The downhole test/treat assembly and the conveyance coiled tubing string are deployed into the injector head assembly and the BOP assembly and run into the production tubing 52 to a depth of about 500 feet as shown in FIG. 2. As shown in FIG. 3, the injector head assembly 18 is removed, exposing a portion of the conveyance coiled tubing string which is cut off.

As shown in FIG. 4, the downhole conveyance assembly 72 is connected to the upper terminus 81 of the conveyance coiled tubing string and to the terminus 71 of the coiled tubing string 70.

As shown in FIG. 5, the injector head assembly is, reconnected to the BOP stack and the downhole test/treat assembly 86, the downhole stripper 84 and the downhole conveyance assembly 72 are run into the well to a depth of about 8600 feet. While running into the well, the ACTIV is closed to the annulus 114. While running in the well the DSRV is closed to reverse flow, up towards the surface. At this depth the downhole stripper 84 is proximate the landing nipples 100. Sufficient compressive force is then applied to the coiled tubing string 70, which is transmitted through the conveyance coiled tubing string 82 to the downhole stripper 84 which locks it in place with the landing nipples 100.

When the downhole stripper is locked in place at about 8600 feet, it also seals the production tubing and isolates it from the rest of the well.

Additional compressive force on the coiled tubing string 70 releases the downhole stripper from the downhole test/treat assembly 86. This allows the conveyance coiled tubing string 82 to slip through the downhole stripper 84 as more of the coiled tubing string 70 is run in the well as best seen in FIG. 6.

The packers 94 and 96 are positioned so they straddle the third production zone 62 at about 9,000 feet, as shown in FIG. 7. Once the straddle packers have reached the desired setting depth, the coiled tubing string 70 will be moved up hole to deactivate the check valves in the DSRV. This will then allow both direct flow down into the well and reverse flow up to the surface. Again, the structure and operation of the DSRV are more fully described in the prior patent application identified above and incorporated herein by reference.

A pump, not shown, pumps fluid down the coiled tubing string 70, through the downhole conveyance assembly 72, through the conveyance coiled tubing string 82, and through the downhole test/treat assembly 86 to inflate the straddle packers 94 and 95 as shown in FIG. 8. When the packers have been set, the third production zone 62 is isolated from the rest of the well by the packers which seal against the inside circumference of the production casing liner 46.

Assuming that only the third production zone 62 needs treatment, it is not necessary to reposition the packers from the location shown in FIG. 10. In order to treat the third production zone 62, the coiled tubing string is then put into tension sufficiently to cycle the mechanism in the ACTIV to the closed to annulus position and, when weight is set back down, the ACTIV open ports 128 then prevent annular communication. The treatment fluid is pumped down the coiled tubing string 70, through the downhole conveyance assembly 72, through the conveyance coiled tubing string 82, and through the downhole test/treat assembly 86 as shown in FIG. 9 into the third production zone 62. After a sufficient amount of treatment fluid has been pumped in the well, the pump is stopped.

The coiled tubing string is then put into tension sufficiently to cycle the mechanism in the ACTIV 78 to the open to annulus position and, and when weight is set back down, the ACTIV open ports 128 then allow annular communication. In other words, fluid flows towards the surface through the conveyance coiled tubing string 82 through the connector 80, and through the open ports to the annulus 114.

The flowpath for the commingled fluid (treatment fluid and formation fluid) is the same as shown in FIG. 10. The commingled fluid flows from the third production zone, through the downhole test/treat assembly 86, through the conveyance coiled tubing string 82, through the downhole conveyance assembly 72 and out the open ports 128 of the ACTIV 78 into the annulus 114. The commingled fluid flows up the annulus 114 to the wellhead and out the wellhead outlet 39. This flowpath up the annulus instead of the coiled tubing 70 differentiates the present method for the prior art for both testing and treatment of a well. After the formation has cleared itself of the treatment fluid, the production wing valves in the wellhead can be closed to stop the flow.

Once a treatment is completed, the straddle packers can be unset with tension applied and moved uphole to treat another production zone, if necessary. Once all production zones have been treated, the downhole test/treat assembly 86 is retrieved from the well. On the way out of the well, the downhole stripper 84 is disengaged and retrieved with the downhole test/treat assembly.

Operational Example of the Alternative Embodiment of FIG. 11

The following example is hypothetical example using the alternative embodiment of FIG. 11 to test and treat a well. This example will refer to FIGS. 3–10, however the assembly 86 in these figures should be replaced with the alternative embodiment of the downhole test/treat assembly 122 as shown in FIG. 11.

A well is approximately 10,000 feet deep with a first production zone at approximately 8750 feet, a second production zone at approximately 8850 feet deep and a third production zone at approximately 9000 feet deep. Casing has been set to approximately 8600 feet in the hole followed by a production casing liner for approximately from 8500 to 10000 feet. Production tubing has been installed to approximately 8700 feet. A hanger liner with packoff 50 has been set between the casing and the production casing liner at approximately 8550 feet. Landing nipples are positioned in the production tubing at approximately 8600 feet. The completion packer 56 is set at about 8450 feet between the casing and the production tubing.

A conventional coiled tubing unit is brought to the well and the well is shut in. The BOP assembly is connected to the wellhead and the injector head assembly is mounted on the BOP assembly. In this hypothetical example the alternative embodiment of the downhole test/treat assembly 122 is substituted for the assembly 86 shown in FIG. 3. The alternative embodiment of the downhole test/treat assembly 122 with a single packer is connected to the lower terminus 83 of the conveyance coiled tubing string 82. The alternative embodiment of the downhole test/treat assembly 122 and the conveyance coiled tubing string are deployed into the injector head assembly and the BOP assembly and run into the production tubing 52 to a depth of about 500 feet similar to the apparatus shown in FIG. 2. The injector head assembly 18 is removed, exposing a portion of the conveyance coiled tubing string which is cut off.

As shown in FIG. 4, the downhole conveyance assembly 72 is connected to the upper terminus 81 of the conveyance coiled tubing string and to the terminus 71 of the coiled tubing string 70, except the alternative embodiment of the downhole test/treat assembly 122 is substituted for the assembly 86 shown in FIG. 4.

As shown in FIG. 5 with the substitution of the assembly 122 for the assembly 86, the injector head assembly is, reconnected to the BOP stack and the downhole test/treat assembly 122, the downhole stripper 84 and the downhole conveyance assembly 72 are run into the well to a depth of about 8600 feet. While running into the well, the ACTIV is closed to the annulus 114. While running in the well the DSRV is closed to reverse flow, up towards the surface. At this depth the downhole stripper 84 is proximate the landing nipples 100. Sufficient compressive force is then applied to the coiled tubing string 70, which is transmitted through the conveyance coiled tubing string 82 to the downhole stripper 84 which locks it in place with the landing nipples 100. When the downhole stripper is locked in place at about 8600 feet, it also seals the production tubing and isolates it from the rest of the well.

Additional compressive force on the coiled tubing string 70 releases the downhole stripper from the downhole test/treat assembly 122. This allows the conveyance coiled tubing string 82 to slip through the downhole stripper 84 as more of the coiled tubing string 70 is run in the well as best seen in FIG. 6.

The packer 94 is positioned above the third production zone 62 at about 9,000 feet. As shown in FIG. 11. Once the packer has reached the desired setting depth, the coiled tubing string 70 will be moved up hole to deactivate the check valves in the DSRV. This will then allow both direct flow down into the well and reverse flow up to the surface. Again, the structure and operation of the DSRV are more fully described in the prior patent application identified above and incorporated herein by reference.

A pump, not shown, pumps fluid down the coiled tubing string 70, through the downhole conveyance assembly 72, through the conveyance coiled tubing string 82, and through the downhole test/treat assembly 122 to inflate the straddle packer 94 as shown in FIG. 11. When the packer has been set, the third production zone 62 is isolated from the rest of the well by the packers which seal against the inside circumference of the production casing liner 46.

To test the third production zone, the coiled tubing string is then put into tension sufficiently to cycle the mechanism in the ACTIV 78 to the open to annulus position and, when weight is set back down, the ACTIV open ports 128 then allow annular communication. In other words, fluid flows towards the surface through the conveyance coiled tubing string 82 through the connector 80, and through the open ports to the annulus 114. The well is allowed to flow from the third production zone as shown in FIG. 10, through the downhole test/treat assembly 122, through the conveyance coiled tubing string 82, through the downhole conveyance assembly 72 and out the ACTIV 78 into the annulus 114. The formation fluid passes through the wellhead and out the wellhead outlet 39. The logging tool assembly 93 measures flow, temperature and other variables to test the third production zone 62. Data from the logging tool 93 can be sent in real time up to the surface by electric wireline logging cable, preinstalled in the coiled tubing. In the alternative, the data can be stored in memory and analyzed after the logging tool is removed from the well. In the preferred embodiment, the data is sent to the surface while the logging tool assembly is still in the well. This alternative embodiment can only be used to test/treat the lowest production zone in a well with multiple completions.

In order to treat the third production zone 62, the coiled tubing string is then put into tension sufficiently to cycle the mechanism in the ACTIV to the closed to annulus position and, when weight is set back down, the ACTIV open ports 128 then prevent annular communication. The treatment fluid is pumped down the coiled tubing string 70, through the downhole conveyance assembly 72, through the conveyance coiled tubing string 82, and through the downhole test/treat assembly 122 similar to the apparatus as shown in FIG. 9 into the third production zone 62. After a sufficient amount of treatment fluid has been pumped in the well, the pump is stopped.

The coiled tubing string is then put into tension sufficiently to cycle the mechanism in the ACTIV 78 to the open to annulus position and, and when weight is set back down, the ACTIV open ports 128 then allow annular communication. In other words, fluid flows towards the surface through the conveyance coiled tubing string 82 through the connector 80, and through the open ports to the annulus 114.

The flowpath for the commingled fluid is similar to the path as shown in FIG. 10. The commingled fluid flows from the third production zone, through the downhole test/treat assembly 122, through the conveyance coiled tubing string 82, through the downhole conveyance assembly 72 and out the open ports 128 of the ACTIV 78 into the annulus 114. The commingled fluid flows up the annulus 114 to the wellhead and out the wellhead outlet 39. This flowpath up the annulus instead of the coiled tubing 70 differentiates the present method for the prior art for both testing and treatment of a well. After the formation has cleared itself of the treatment fluid, the production wing valves in the wellhead can be closed to stop the flow.

Once a treatment is completed, the packer can be unset with tension applied and retrieved from the well. On the way out of the well, the downhole stripper 84 is disengaged and retrieved with the downhole test/treat assembly 122.

In some situations, it may only be necessary to treat a well. When the assembly 122 is being used solely for treatment of a well the logging tool assembly 93 is an optional component. Treatment of a well using this alternative embodiment 122 is similar to the prior treatment example, except the assembly 122 is substituted for the assembly 86.

Operational Example of the Alternative Embodiment as Shown in FIG. 12

The following example is hypothetical example using the alternative embodiment 122 as shown in FIG. 12 to test and treat a well that has a mechanical or inflatable bridge plug 124 that has been previously run and set in the well below the production zone of interest. In this hypothetical example, the bridge plug has been set below the second production zone 60. This example will refer to FIGS. 3–10, however the assembly 86 in these figures should be replaced with the alternative embodiment of the downhole test/treat assembly 122 as shown in FIG. 12.

A well is approximately 10,000 feet deep with a first production zone at approximately 8750 feet, a second production zone at approximately 8850 feet deep and a third production zone at approximately 9000 feet deep. Casing has been set to approximately 8600 feet in the hole followed by a production casing liner for approximately from 8500 to 10000 feet. Production tubing has been installed to approximately 8700 feet. A hanger liner with packoff 50 has been set between the casing and the production casing liner at approximately 8550 feet. Landing nipples are positioned in the production tubing at approximately 8600 feet. The completion packer 56 is set at about 8450 feet between the casing and the production tubing. An inflatable bridge plug has been set at about 8875 feet in the well.

A conventional coiled tubing unit is brought to the well and the well is shut in. The BOP assembly is connected to the wellhead and the injector head assembly is mounted on the BOP assembly. In this hypothetical example the alternative embodiment of the downhole test/treat assembly 122 is substituted for the assembly 86 shown in FIG. 3. The alternative embodiment of the downhole test/treat assembly 122 with a single packer is connected to the lower terminus 83 of the conveyance coiled tubing string 82. The alternative embodiment of the downhole test/treat assembly 122 and the conveyance coiled tubing string are deployed into the injector head assembly and the BOP assembly and run into the production tubing 52 to a depth of about 500 feet similar to the apparatus shown in FIG. 2. The injector head assembly 18 is removed, exposing a portion of the conveyance coiled tubing string which is cut off.

As shown in FIG. 4, the downhole conveyance assembly 72 is connected to the upper terminus 81 of the conveyance coiled tubing string and to the terminus 71 of the coiled tubing string 70, except the alternative embodiment of the downhole test/treat assembly 122 is substituted for the assembly 86 shown in FIG. 4.

As shown in FIG. 5 with the substitution of the assembly 122 for the assembly 86, the injector head assembly is, reconnected to the BOP stack and the downhole test/treat assembly 122, the downhole stripper 84 and the downhole conveyance assembly 72 are run into the well to a depth of about 8600 feet. While running into the well, the ACTIV is closed to the annulus 114. While running in the well the DSRV is closed to reverse flow, up towards the surface. At this depth the downhole stripper 84 is proximate the landing nipples 100. Sufficient compressive force is then applied to the coiled tubing string 70, which is transmitted through the conveyance coiled tubing string 82 to the downhole stripper 84 which locks it in place with the landing nipples 100. When the downhole stripper is locked in place at about 8600 feet, it also seals the production tubing and isolates it from the rest of the well.

Additional compressive force on the coiled tubing string 70 releases the downhole stripper from the downhole test/treat assembly 122. This allows the conveyance coiled tubing string 82 to slip through the downhole stripper 84 as more of the coiled tubing string 70 is run in the well as best seen in FIG. 6.

The packer 94 is positioned above the second production zone 60. As shown in FIG. 12. Once the packer has reached the desired setting depth, the coiled tubing string 70 will be moved up hole to deactivate the check valves in the DSRV. This will then allow both direct flow down into the well and reverse flow up to the surface. Again, the structure and operation of the DSRV are more fully described in the prior patent application identified above and incorporated herein by reference.

A pump, not shown, pumps fluid down the coiled tubing string 70, through the downhole conveyance assembly 72, through the conveyance coiled tubing string 82, and through the downhole test/treat assembly 122 to inflate the packer 94 as shown in FIG. 12. When the packer has been set, the third production zone 62 is isolated from the rest of the well by the packers which seal against the inside circumference of the production casing liner 46.

To test the second production zone, the coiled tubing string is then put into tension sufficiently to cycle the mechanism in the ACTIV 78 to the open to annulus position and, when weight is set back down, the ACTIV open ports 128 then allow annular communication. In other words, fluid flows towards the surface through the conveyance coiled tubing string 82 through the connector 80, and through the open ports to the annulus 114. The well is allowed to flow from the second production zone through the downhole test/treat assembly 122, through the conveyance coiled tubing string 82, through the downhole conveyance assembly 72 and out the ACTIV 78 into the annulus 114. The formation fluid passes through the wellhead and out the wellhead outlet 39. The logging tool assembly 93 measures flow, temperature and other variables to test the third production zone 62. Data from the logging tool 93 can be sent in real time up to the surface by electric wireline logging cable, preinstalled in the coiled tubing. In the alternative, the data can be stored in memory and analyzed after the logging tool is removed from the well. In the preferred embodiment, the data is sent to the surface while the logging tool assembly is still in the well.

In order to treat the second production zone 62, the coiled tubing string is then put into tension sufficiently to cycle the mechanism in the ACTIV to the closed to annulus position and, when weight is set back down, the ACTIV open ports 128 then prevent annular communication. The treatment fluid is pumped down the coiled tubing string 70, through the downhole conveyance assembly 72, through the conveyance coiled tubing string 82, and through the downhole test/treat assembly 122 similar to the apparatus as shown in FIG. 9 into the third production zone 62. After a sufficient amount of treatment fluid has been pumped in the well, the pump is stopped.

The coiled tubing string is then put into tension sufficiently to cycle the mechanism in the ACTIV 78 to the open to annulus position and, and when weight is set back down, the ACTIV open ports 128 then allow annular communication. In other words, fluid flows towards the surface through the conveyance coiled tubing string 82 through the connector 80, and through the open ports to the annulus 114.

The flowpath for the commingled fluid is similar to the path as shown in FIG. 10, except he second production zone is being treated and not the third zone. The commingled fluid flows from the second production zone, through the downhole test/treat assembly 122, through the conveyance coiled tubing string 82, through the downhole conveyance assembly 72 and out the open ports 128 of the ACTIV 78 into the annulus 114. The commingled fluid flows up the annulus 114 to the wellhead and out the wellhead outlet 39. This flowpath up the annulus instead of the coiled tubing 70 differentiates the present method for the prior art for both testing and treatment of a well. After the formation has cleared itself of the treatment fluid, the production wing valves in the wellhead can be closed to stop the flow.

Once a treatment is completed, the packer can be unset with tension applied and retrieved from the well. On the way out of the well, the downhole stripper 84 is disengaged and retrieved with the downhole test/treat assembly 122.

In some situations, it may only be necessary to treat a well. When the assembly 122 is being used solely for treatment of a well the logging tool assembly 93 is an optional component. Treatment of a well using this alternative embodiment 122 is similar to the prior treatment example, except the assembly 122 is substituted for the assembly 86.

What is claimed is:

1. A method for testing a well with production tubing in place and multiple production zones comprising:

connecting a downhole test assembly and downhole stripper to a conveyance coiled tubing string;

deploying the downhole test assembly, downhole stripper and the conveyance coiled tubing string in the well;

running a sufficient length of the conveyance coiled tubing string into the well;

hanging the conveyance coiled tubing string, the downhole test assembly and the downhole stripper off of a BOP and removing the injector head assembly to expose a portion of the conveyance coiled tubing string;

cutting the conveyance coiled tubing string and connecting a downhole conveyance assembly and coiled tubing string;

running the coiled tubing string, the downhole conveyance assembly, the coiled tubing string, the downhole stripper and the test assembly into the production tubing;

engaging the downhole stripper with the production tubing;

running the coiled tubing string and the downhole conveyance assembly into the well and the conveyance coiled tubing string through the downhole stripper to a depth where the test assembly is adjacent a production zone;

setting at least one packer;

flowing formation fluid from the production zone up to and out the wellhead, through the test assembly, through the conveyance coiled tubing string, through a portion of the downhole conveyance assembly and through the annulus between the coiled tubing string and the production tubing; and testing the production zone.

2. A method for fluid treatment of a well with production tubing in place and multiple production zones comprising:

connecting a downhole treat assembly and downhole stripper to a conveyance coiled tubing string;

deploying the downhole treat assembly, downhole stripper and the conveyance coiled tubing string in the well;

running a sufficient length of the conveyance coiled tubing string into the well;

hanging the conveyance coiled tubing string, the downhole treat assembly and the downhole stripper off of a BOP and removing the injector head assembly to expose a portion of the conveyance coiled tubing string;

cutting the conveyance coiled tubing string and connecting a downhole conveyance assembly and coiled tubing string;

running the coiled tubing string, the downhole conveyance assembly, the conveyance coiled tubing string, the downhole stripper and the downhole treat assembly into the production tubing;

engaging the downhole stripper with the production tubing;

running the coiled tubing string and the downhole conveyance assembly into the well and the conveyance coiled tubing string through the downhole stripper to a depth where the downhole treat assembly is adjacent a production zone;

setting at least one packer;

pumping a treatment fluid down through the coiled tubing string, through the downhole conveyance assembly, through the conveyance coiled tubing string and through the treat assembly into a single production zone;

flowing treatment fluid and formation fluid from the production zone up to and out the wellhead through the downhole treat assembly, through the conveyance coiled tubing string, through a portion of the downhole conveyance assembly and through the annulus between the coiled tubing string and the production tubing;

unsetting all packers;

retrieving the downhole treat assembly, the conveyance coiled tubing string, the downhole stripper, the downhole conveyance assembly and the coiled tubing string from the well and disengaging the downhole stripper on the way out.

3. A method for improving production of a well with production tubing in place and multiple production zones comprising:

a) testing each production zone by:

connecting an downhole test/treat assembly and downhole stripper to a conveyance coiled tubing string;

deploying the downhole test/treat assembly, downhole stripper and the conveyance coiled tubing string in the well;

running a sufficient length of the conveyance coiled tubing string into the well;

hanging the conveyance coiled tubing string, the downhole test/treat assembly and the downhole stripper off of a BOP and removing the injector head assembly to expose a portion of the conveyance coiled tubing string;

cutting the conveyance coiled tubing string and connecting a downhole conveyance assembly and coiled tubing string;

running the coiled tubing string, the downhole conveyance assembly, the conveyance coiled tubing string, the downhole stripper and the downhole test/treat assembly into the production tubing;

engaging the downhole stripper with the production tubing;

running the coiled tubing string and the downhole conveyance assembly into the well and the conveyance coiled tubing string through the downhole stripper to a depth where the downhole test/treat assembly is adjacent a production zone;

setting at least one packer;

flowing formation fluid from the production zone up to and out the wellhead through the downhole test/treat assembly, through the conveyance coiled tubing string, through a portion of the downhole conveyance assembly and through the annulus between the coiled tubing string and the production tubing; and testing the production zone;

b) treating at least one production zone by:

pumping a treatment fluid down through the coiled tubing string, through the downhole conveyance assembly, through the conveyance coiled tubing string and through the downhole test/treat assembly into at least one production zone; and flowing treatment fluid and formation fluid from the at least one production zone up to and out the wellhead through the downhole test/treat assembly, through the conveyance coiled tubing string, through a portion of the downhole conveyance assembly and through the annulus between the coiled tubing string and the production tubing, the annulus being located above the downhole stripper.

4. The method of claim 3 further including:

testing each production zone by;

flowing formation fluid from the production zone up to and out the wellhead through the downhole test/treat assembly, through the conveyance coiled tubing string, through a portion of the downhole conveyance assembly and through the annulus between the coiled tubing string and the production tubing, the annulus being above the downhole stripper; and testing the production zone.

5. The method of claim 4 further including:

pumping a treatment fluid down through the coiled tubing string, through the downhole conveyance assembly, through the conveyance coiled tubing string and through the downhole test/treat assembly into at least one production zone; and flowing treatment fluid and formation fluid from the at least one production zone up to and out the wellhead, through the downhole test/treat assembly, through the conveyance coiled tubing string, through a portion of the downhole conveyance assembly and through the annulus between the coiled tubing string and the production tubing, the annulus being located above the downhole stripper.

6. The method of claim 4 further including:

after positive test results;

unsetting all packers; and retrieving the downhole test/treat assembly, the conveyance coiled tubing string, the downhole stripper, the downhole conveyance assembly and the coiled tubing string from the well and disengaging the downhole stripper on the way out.

* * * * *